US005225844A

United States Patent [19]

Williams

[11] Patent Number: 5,225,844

[45] Date of Patent: Jul. 6, 1993

[54] ROTOR MODULATION SUPPRESSOR

[75] Inventor: Austin M. Williams, Diamond Bar, Calif.

[73] Assignee: Hughes Aircraft Company, Los Angeles, Calif.

[21] Appl. No.: 689,679

[22] Filed: Apr. 23, 1991

Related U.S. Application Data

[63] Continuation of Ser. No. 447,732, Dec. 8, 1989, abandoned.

[51] Int. Cl.[5] ..... H01Q 1/28

[52] U.S. Cl. ..... 343/705

[58] Field of Search ..... 343/705, 708, 787, 722

[56] References Cited

U.S. PATENT DOCUMENTS 4,092,646 5/1978 Newington ..... 343/749

4,635,066 1/1987 St. Clair et al. ..... 343/705

*Primary Examiner*—Michael C. Wimer

*Attorney, Agent, or Firm*—Wanda K. Denson-Low

[57] ABSTRACT

The invention is a device for reducing modulation of high frequency signals induced by helicopter rotor blades made of high strength composites and having a metalized leading edge. The device uses a segmented metalized leading edge. The segments are electrically connected by reactive elements selected to alter the self-resonant frequency of the rotor blade and to reduce the antenna Q to a non-interfering frequency range. The reactive elements use "lossy" materials to absorb energy to reduce the magnitude of radio frequency signal induced currents.

21 Claims, 3 Drawing Sheets 100
10
1
.1
CURRENT (mA)
33
35
41
1
3
10
30
FREQUENCY (MHz)

ROTOR MODULATION SUPPRESSOR

This is a continuation-in-part of application Ser. No. 07,447,732, filed Dec. 8, 1989, now abandoned.

BACKGROUND

The present invention relates generally to communications devices used on helicopters and in a particular to an electrical device for reducing modulation of radio frequency signals produced by metalized surfaces of a helicopter rotor blade.

It is well known that high frequency radio signals radiated from communications equipment aboard a helicopter produce high frequency currents in the rotor blades of a helicopter. These high frequency currents are subsequently reradiated with the rotor blade functioning as an antenna. The reradiated signals, in turn, produce audio frequency modulation of the reradiated signal as a consequence of the rotation of the helicopter blades. This modulation can be in the form of both amplitude modulation and frequency modulation.

More recently, the use of high strength composite materials such as graphite composites has enabled the production of helicopter rotor blades of relatively low conductivity thereby substantially alleviating this problem. However, it has been found necessary to provide metalized surfaces on the leading edge of high strength composite helicopter rotor blades to resist abrasion and damage to the blades caused by such things as sand and dust in the air. These metalized leading edges again result in highly conductive rotating elements which produce modulation of high frequency radio signals. Prior art solutions for this problem have included isolation of the high frequency antenna from the rotor blades, use of low impedance loop or inductive antennas, and avoidance of known frequencies at which rotor modulation is troublesome. Each of these solutions present their own limitations. Therefore there still exists a need to provide a device which will significantly reduce rotor blade modulation thereby enhancing the quality of radio frequency communications to and from the helicopter.

SUMMARY OF THE INVENTION

Broadly the present invention is a device for suppressing modulation of high frequency radio signals caused by a helicopter rotor blade. The helicopter rotor blade is made of a high strength composite material such as a graphite composite. The leading edge of the blade is provided with a plurality of juxtaposed metalized surface segments. The individual segments are connected electrically in series by a plurality of reactive circuit elements having reactance values to alter the resonant frequency and Q of the rotor. The reactive devices may be inductive elements made of a material which exhibits relatively high energy loses with the inductive value of the elements being selected to lower the resonant frequency of the rotor to a frequency range below that of a helicopters radio frequency communication equipment. The inductive elements may be made of a powdered ferrite material which produces significant energy loss and lowering of induced currents. Alternately, the segments may be arranged in an overlapping configuration and a dielectric material such as Kevlar interposed between the segments. The resulting capacitive connection detunes the metalized segments thereby substantially increasing the resonant frequency of the rotor. The individual reactive elements may be connected in parallel with a plurality of lightning diverters to protect the elements from high voltage arching.

It is therefore an advantage of the invention to provide a high strength composite helicopter rotor blade having significantly improved rotor induced modulation of radio frequency signals.

Another advantage of the invention is to provide a helicopter rotor blade modulation suppressor comprised of a plurality of reactive circuit elements electrically connecting metalized rotor blade segments to alter the resonant frequency and Q of the rotor blade.

Still another advantage of the invention is to provide such a device in which the reactive elements are inductive elements which lower the resonant frequency of the rotor blade segments to a frequency range below that of the high frequency radio communication equipment of a helicopter.

Yet another advantage of the invention is to provide such a device in which inductive elements are made of a material which exhibits high energy losses at helicopter communication equipment operating frequencies to thereby reduce high frequency currents induced in the blades.

Another advantage of the invention is to provide such a device in which overlapping metalized segments are separated by dielectric material to effect capacitive coupling therebetween to detune the segments.

Still another advantage of the invention is to provide such a device formed of thin film elements which do not aerodynamically affect the rotor blade.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which.

DETAILED DESCRIPTION

Figure 1:
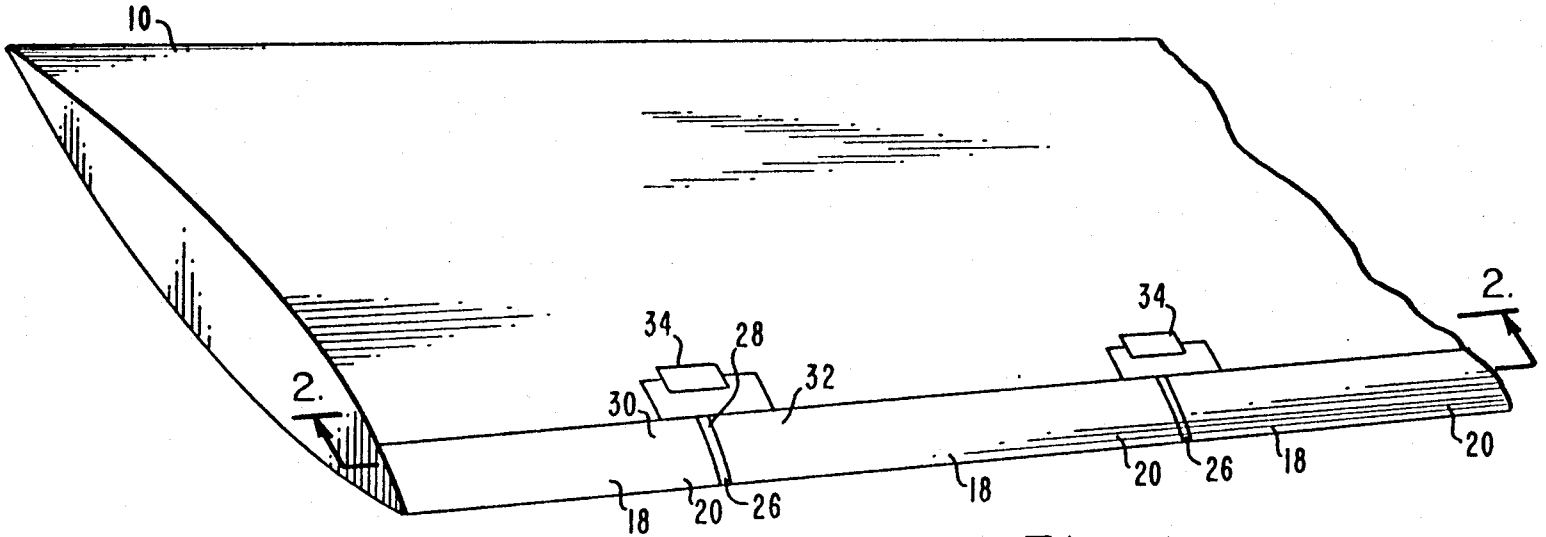
FIG. 1 is a fragmentary prospective view of a section of a high strength composite helicopter rotor blade incorporating the present invention.

Referring now to the drawings, there is shown in FIG. 1 a fragmentary section 10 of a helicopter rotor blade. Since each rotor blade is substantially identical and each of the blades is substantially uniform in construction throughout its length a description of the fragmentary section of the blade is sufficient for a description of the entire blade and for all of the blades. In all figures, like elements have like numerals. The blade is fabricated from a composite material, typically carbon fibers which may be laid in longitudinally extending configuration or may be formed of woven fabrics or the like. The carbon fibers are bound together with a high strength resin matrix. The blade, as is well known in the art, may be formed in a female mold or as a homogeneous bundle and subsequently machined to desired dimensions and finish.

The leading edge 12 of the blade 10 is preferably formed with a reduced section to define recess 14 which extends the length of the leading edge 16. A plurality of metal or metalized segments 18 are fitted into the recess 14. The segments 18 can be formed by spraying a metallic material, vacuum deposited, or may comprise preformed sheet metal elements which are bonded into the recesses 14. As best seen in FIG. 1, the segments 18 form a substantially continuous leading edge to protect the leading edge 16 of the composite blade from abrasion. The segments 18 are disposed longitudinally of the blade and may further be separated into upper and lower segments 20, 22 by a division line as at 24.

Because the segments 18 are metallic, high frequency currents are induced in the segments as a consequence of radio frequency signals radiated from the antenna or antennas of a helicopter communication system. A more detailed discussion of such induced currents is presented in the paper entitled "Modeling HF Loop Antennas on the CHSS-2 "Sea King" Helicopter by Y. A. Bahsoun, S. J. Kubina, and C. W. Trueman at the 1982 International Symposium Digest Antennas and Propagation, Vol. 2, Institute of Electrical and Electronics Engineers on May 24–28, 1982.

The individual segments 18 are electrically isolated each from the others by a mechanical space 26. The spaces 26 receive suitable reactive elements 28 which electrically connect adjacent ends 30, 32 of adjacent segments 18.

Figure 2A:
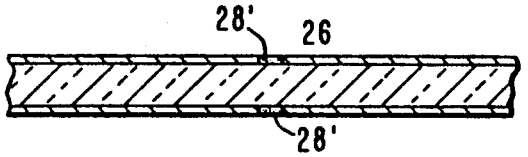
FIGS. 2*a*, 2*b*, and 2*c* are sectional views of alternative embodiments of the invention taken generally along a section line of 2—2 of FIG. 1.
Figure 2B:
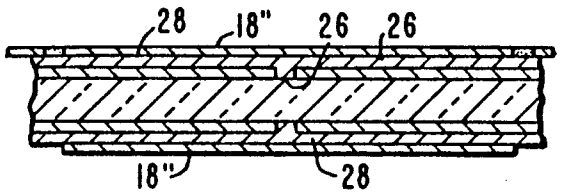
Figure 2C:
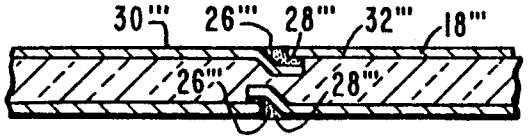
Figure 5:
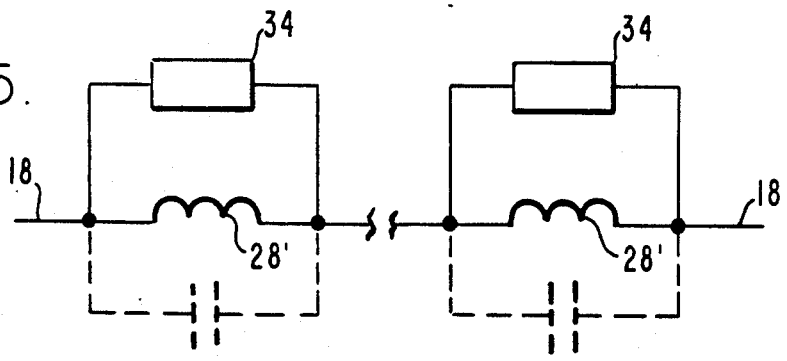
FIG. 5 is an electrical schematic of the equivalent circuit of inductively coupled rotor segments.

Referring to FIGS. 2A–2C, there are shown three representative embodiments of reactive elements 28', 28'', and 28'''. In the embodiment of FIG. 2A, the spaces 26 are rectangular and filled with a ferrite compound 28'. The ferrite compound 28' provides electrical connection between adjacent ends of 30, 32 of segments 1B. The ferrite compound 28' in conjunction with the metallic segments 18, forms an inductor. The effective electrical circuit for this embodiment is shown in FIG. 5. By proper selection of the physical dimensions and composition of the ferrite elements 28' and the length of the segments 18, the Q, which is a measure of the antenna efficiency, and the resonant frequency can be selectively altered. For example, referring to FIG. 3, the Q of a typical rotor with a metallic leading edge is shown at 33. The Q chart of the same rotor in which the metallic leading edge is separated into a plurality of segments and joined by inductive elements 28' is shown at 35.

In reference to FIG. 2B, the reactive elements can also be provided in the form of capacitors. In this embodiment, the metallic leading edge segments are formed in overlapping segments 18'' which are electrically separated by a suitable dielectric 37 such as, for example, Kevlar or other high K dielectric material. The equivalent electrical circuit is shown in FIG. 6.

The embodiment of FIG. 2C is similar to that of FIG. 2A with the exception that the adjacent ends 30, 32 of segments 18''' are formed in overlapping configuration with the leading edge 16 of the blade 10 being provided with suitable complimentary recesses to preserve the aerodynamic integrity of the blade. The spaces 26''' are again filled with a suitable ferrite powder and resin to form the inductive elements 28'''. It should be noted that when the reactive elements are formed as capacitors, the antenna functioning segments 18 are basically detuned as shown at 39 in FIG. 3 whereas when the segments are electrically connected by inductive elements 28' or 28''', the Q on the antenna segments is substantially lowered. It will also be seen in FIG. 3 that the resonant frequency of the segments is moved. In both cases, the material selected for the inductive element or for the dielectric is a material having a significant resistive or energy absorbing characteristic at high frequencies. This further substantially lowers the induced currents in segments 18 thereby significantly reducing rotor induced radio frequency modulation of high frequency radio signals transmitted from or to the helicopter.

Figure 6:
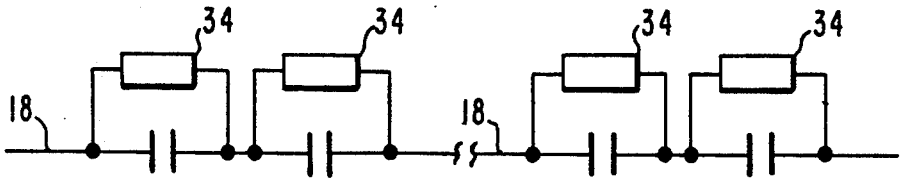
FIG. 6 is an electrical schematic of the equivalent circuit of capacitive coupled rotor segments.

With reference to FIGS. 1, 5, and 6, a suitable lightning diverter or high voltage arrestor 34 may be connected electrically in parallel with each of the reactive elements 28–28'''. These lightning diverters are well known in the art and can be provided in the form of relatively thin film elements disposed within recesses formed in the surfaces of the rotor blade 10.

Figure 3:
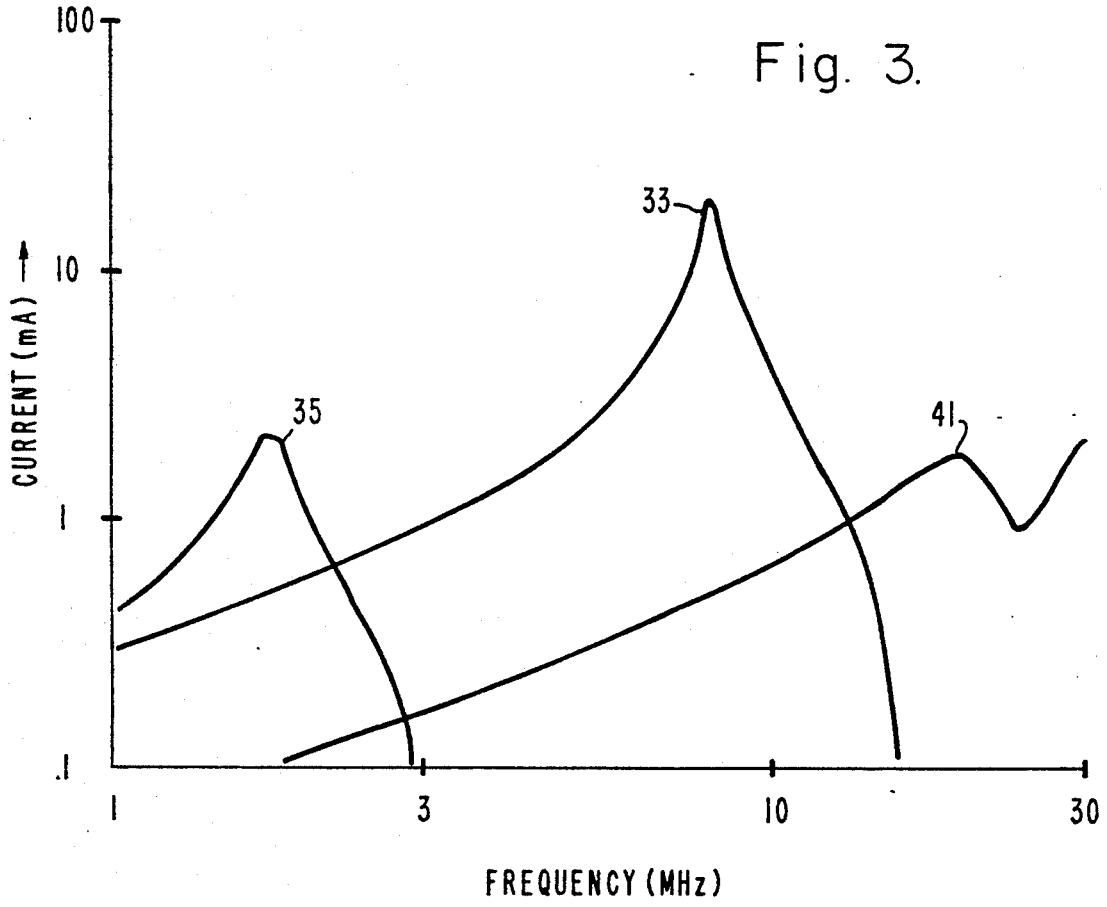
FIG. 3 is a diagram showing the effect of the present invention on the resonant frequency, Q and induced currents of the helicopter blade.
Figure 4:
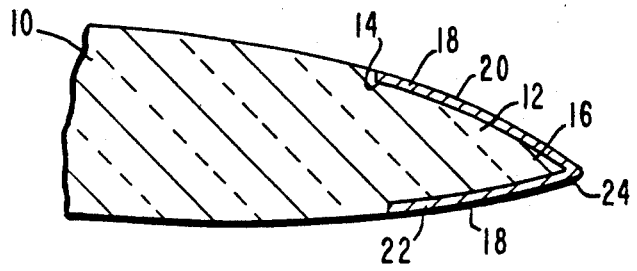
FIG. 4 is a lateral cross sectioned view showing elements of the metalized segments and rotor blade.

In a computer simulated model of the present invention, it had been determined that providing segments 18 having lengths of ¼ wavelength, interconnected with inductive elements 28 having an inductance of 60 mh will produce a rotor blade having a Q which peaks at a frequency range of about 2 MHz the peak of the induced current being reduced from about 30 ma to 1.5 ma. In a capacitive loaded embodiment, a capacitance of 60 pf, and one quarter wavelength segments produces wave 41 of FIG. 3 showing substantial detuning of the segmental leading edge and a similar reduction in induced currant levels. The specific dimensions of the reactive elements and segments can be varied as desired for specific applications in accordance with well known relationships. Upon selecting a frequency range offset from the operating frequencies of the helicopter communication equipment, the various dimensions for the segments and reactive elements can be readily determined.

From the above description, it will be seen that the present invention provides an effective means for significantly reducing the Q of metallic leading edge structures on a high strength composite helicopter rotor blade. This in turn will effectively and substantially reduces rotor induced modulation of high frequency radio signals transmitted from or to a helicopter thereby enhancing the quality of communications therewith. The above examples are presented as representative examples of the invention but the invention is not limited thereto, other modifications being apparent to those skilled in the art in view of the above description of the invention.

What is claimed is:

1. For use with a helicopter communication equipment operating at predetermined frequencies and composite rotor blades, a rotor blade radio frequency signal modulation suppressor comprising: a plurality of juxtaposed metallic surface segments overlying the leading edge of the rotor blade, reactive circuit elements comprising ferrite inductors formed between adjacent ones of the metallic surface segments and electrically series connecting the adjacent ends of the metallic surface segments, the physical dimensions and composition of the reactive circuit elements being selected to alter the Q of the rotor blade and resonant frequency of the rotor blade for attenuation of frequencies at the communication equipment operating frequencies.

2. The modulation suppressor of claim 1 wherein the value of the inductors being selected to lower the Q of the metallic surface segments and to lower the resonant frequencies to a frequency offset below the operating frequency of the helicopter communication equipment.

3. The modulation suppressor of claim 2 wherein the metallic surface segments are longitudinally spaced one from the next and are recessed in the leading edge of the rotor blade, the ferrite inductors being received in the spaces between adjacent metallic surface segments and forming an aerodynamically smooth surface therewith.

4. The modulation suppressor of claim 2 wherein the metallic surface segments have overlapping end portions spaced in the direction of the chord of the rotor blade, the overlapping end of one segment being received in a complimentary recess in the surface of the rotor blade, the ferrite inductors being disposed in the space between the overlapping ends, the overlapping ends forming an aerodynamically smooth surface flush with the surface of the rotor blade.

5. The modulation suppressor of claim 1 further including high voltage arc dissipating means for protecting the ferrite inductors from high voltage arcs.

6. The modulation suppressor of claim 5 wherein there is one high voltage dissipating means connected in parallel with each ferrite inductor.

7. The modulation suppressor of claim 2 further including high voltage arc dissipating means for protecting the ferrite inductors from high voltage arcs.

8. The modulation suppressor of claim 7 wherein there is a high voltage dissipating means connected in parallel with each ferrite inductor element.

9. The modulation suppressor of claim 1 wherein the metallic surface segments are longitudinally spaced one from the next and are recessed in the leading edge of the rotor blade, the ferrite inductors being received in the spaces between adjacent metallic surface segments and forming an aerodynamically smooth surface therewith.

10. The modulation suppressor of claim 1 wherein the metallic surface segments have overlapping end portions spaced in the direction of the chord of the rotor blade, the overlapping end of one segment being received in a complimentary recess in the surface of the rotor blade, the ferrite inductors being disposed in the space between the overlapping ends, the overlapping ends forming an aerodynamically smooth surface flush with the surface of the rotor blade.

11. A helicopter rotor of the type made of composite material and having its leading edge covered by a metal layer to resist damage to the composite material during rotation, said rotor having apparatus for suppressing modulation of high frequency radio signals transmitted to or from the helicopter, said modulation being produced by rotation of said rotor, which apparatus comprises:

a) said metal layer being divided into at least two segments that are physically separated from each other; and b) an inductive element disposed on the leading edge of said rotor between adjacent segments of the metal layer, said inductive element electrically connecting adjacent segments.

12. A rotor as recited in claim 11 wherein said inductive element comprises a ferrite powder in a binder.

13. A rotor as recited in claim 11 wherein said inductive element comprises material that absorbs energy at the frequency of said high frequency radio signals.

14. A helicopter rotor of the type made of composite material and having its leading edge covered by a metal layer to resist damage to the composite material during rotation, said rotor having apparatus for suppressing modulation of high frequency radio signals transmitted to or from the helicopter said modulation being produced by rotation of said rotor, which apparatus comprises:

a) said metal layer being divided into at least two segments that are physically separated from each other by spaces; and b) an inductive element disposed on the leading edge of said rotor in each of said spaces between adjacent segments of the metal layer, said inductive element electrically connecting adjacent segments.

15. A rotor as recited in claim 14 wherein said inductive element comprises a ferrite powder in a binder.

16. A rotor as recited in claim 14 wherein said inductive element comprises material that absorbs energy at the frequency of said high frequency radio signals.

17. A helicopter rotor of the type made of composite material and having its leading edge covered by a metal layer to resist damage to the composite material during rotation, said rotor having apparatus for suppressing modulation of high frequency radio signals transmitted to or from the helicopter, said modulation being produced by rotation of said rotor, which comprises:

a) said metal layer being divided into at least two segments; and b) inductive element electrically coupling said at least two segments for providing a resonant frequency of said rotor that is in a different frequency range from the frequency range of said high frequency radio signals.

18. A helicopter rotor as recited in claim 17 wherein the ends of adjacent segments of said metal layer are disposed in an overlapping relationship and an inductive element is disposed between the ends of said adjacent segments.

19. A helicopter rotor as recited in claim 18 wherein said inductive element comprises a ferrite powder in a binder.

20. A helicopter rotor of the type made of composite material and having its leading edge covered by a first metal layer to resist damage to the composite material during rotation, said rotor having apparatus for suppressing modulation of high frequency radio signals transmitted to or from the helicopter, said modulation being produced by rotation of said rotor, which comprises:

a) a second metal layer disposed under said first metal layer; and b) inductive material disposed between said first and second metal layers providing a resonant frequency of said rotor that is in a different frequency range from the frequency range of said high frequency radio signals.

21. A helicopter rotor as recited in claim 20 wherein said second metal layer is divided into at least two segments, said inductive material disposed between adjacent ends of said at least two segments.

* * * * *